US010522281B2

(12) United States Patent
Yeh et al.

(10) Patent No.: US 10,522,281 B2
(45) Date of Patent: Dec. 31, 2019

(54) LARGE-CURRENT INDUCTOR

(71) Applicant: MAG. LAYERS SCIENTIFIC-TECHNICS CO., LTD., Taoyuan (TW)

(72) Inventors: Hsiu-Fa Yeh, Taoyuan (TW); Pin-Yu Chen, Taoyuan (TW); Hang-Chun Lu, Taoyuan (TW); Ya-Wen Yang, Taoyuan (TW); Shih-Kai Huang, Taoyuan (TW); Chien-Chin Chang, Taoyuan (TW); Hung-Chih Liang, Taoyuan (TW); Yu-Ting Hsu, Taoyuan (TW)

(73) Assignee: MAG. LAYERS SCIENTIFIC-TECHNICS CO., LTD., Taoyuan (TW)

( * ) Notice: Subject to any disclaimer, the term of this patent is extended or adjusted under 35 U.S.C. 154(b) by 127 days.

(21) Appl. No.: 15/921,628

(22) Filed: Mar. 14, 2018

(65) Prior Publication Data

US 2019/0287708 A1 Sep. 19, 2019

(51) Int. Cl.
*H01F 27/24* (2006.01)
*H01F 27/28* (2006.01)

(52) U.S. Cl.
CPC ..... *H01F 27/24* (2013.01); *H01F 27/28* (2013.01)

(58) Field of Classification Search
CPC ..... H01F 27/00–36
USPC ... 336/65, 83, 180–184, 192, 200, 212–215, 336/220–223, 232–234
See application file for complete search history.

(56) References Cited

FOREIGN PATENT DOCUMENTS

JP 2002184634 A * 6/2002

* cited by examiner

*Primary Examiner* — Tuyen T Nguyen
(74) *Attorney, Agent, or Firm* — Leong C. Lei

(57) ABSTRACT

The large-current inductor includes a first core member having a first winding piece, a second winding piece, a first indentation, and a second indentation; a second core member having a third winding piece, a fourth winding piece, a third indentation, and a fourth indentation; a third core member attached and joined to first lateral sides of the first and second core members; and a fourth core member attached and joined to second lateral sides of the first and second core members. A first coil member winds around the first and third winding pieces, and has its ends embedded into the first and third indentations. A second coil member winds around the second and fourth winding pieces, and has its ends embedded into the second and fourth indentations. The inductor enhances efficiency of energy storage by mutual inductance, and limits large current flow by leakage inductance.

3 Claims, 5 Drawing Sheets

LARGE-CURRENT INDUCTOR

BACKGROUND OF THE INVENTION

(a) Technical Field of the Invention

The present invention is generally related to inductors, and more particular to a large-current inductor.

(b) Description of the Prior Art

An inductor may function as a choke, winding, filter, transformer, etc. As shown in FIG. 1, a conventional inductor includes a core assembly 10 and a conducting member 15 of an inversed U shape. The core assembly 10 includes a first core member 11 and a second core member 12 above the first core member 11. A trough 13 is provided along where the first and second core members 11 and 12 are interfaced for accommodating the conducting member 15. Another trough 14 is provided along a bottom side of the first core member 11. The conducting member 15 has its two ends inwardly bended into two terminals 16 as the inductor's end terminals. The terminals 16 are embedded into the trough 14.

For this type of conventional inductors, the inductor usually has a greater height or length so as to achieve better inductive performance. However, this would conflict with the current downsizing trend of electronic appliances, especially for those inductors to be applied by surface-mount technology (SMT).

SUMMARY OF THE INVENTION

Therefore, to obviate the shortcomings of the prior art, the present invention provides a novel large-current inductor.

The large-current inductor includes a first core member having a first winding piece, a second winding piece, a first indentation, and a second indentation; a second core member having a third winding piece, a fourth winding piece, a third indentation, and a fourth indentation; a third core member attached and joined to first lateral sides of the first and second core members; and a fourth core member attached and joined to second lateral sides of the first and second core members. A first coil member winds around the first and third winding pieces, and has its ends embedded into the first and third indentations. A second coil member winds around the second and fourth winding pieces, and has its ends embedded into the second and fourth indentations.

Alternatively, the first and third winding are integrated into a fifth winding piece which is extended from the second core member. The second and fourth winding pieces are integrated into a sixth winding piece which is extended from the second core member. The first core member is detachably joined to the first and sixth winding pieces. In yet another embodiment, the first core member includes a first core block and a second core block. The first and second indentations are respectively provided on the first and second core blocks. The second core member includes a third core block and a fourth core block. The third and fourth indentations are respectively provided on the third and fourth core blocks. The first and third winding pieces are integrated into a seventh winding piece, and the second and fourth winding pieces are integrated into an eighth winding piece. The seventh winding piece, the first core block, and the third core block are integrally formed together. The eight winding piece, the second core block, and the fourth core block are integrally formed together.

The large-current inductor enhances efficiency of energy storage by mutual inductance, and limits large current flow by leakage inductance. The large-current inductor therefore may achieve high performance under light load, and may sustain large current under heavy load and a small form factor.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
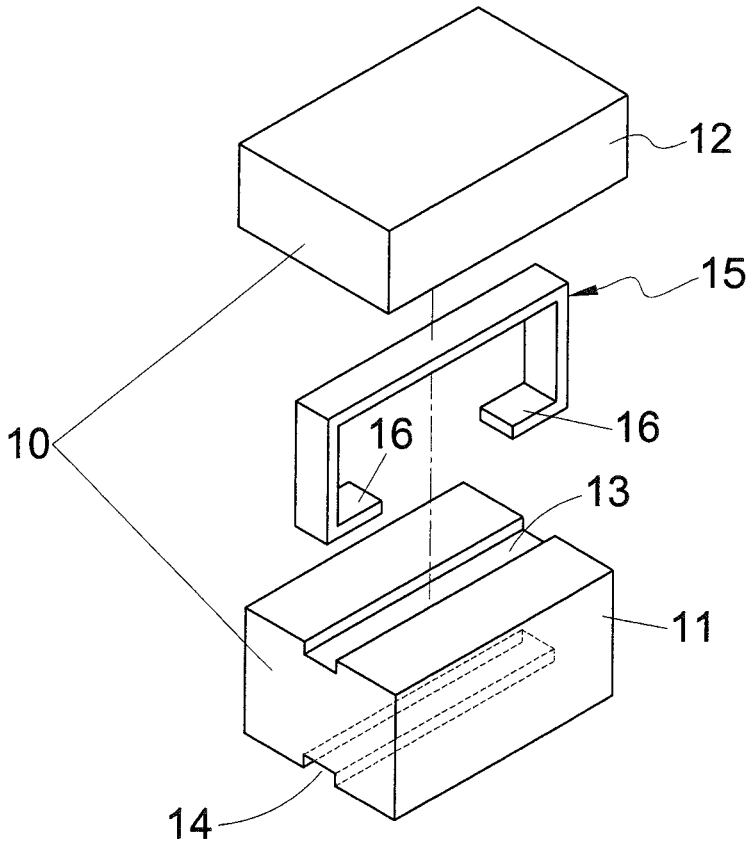
PRIOR ART FIG. 1
FIG. 1 is a perspective breakdown diagram showing a conventional inductor.
Figure 2:
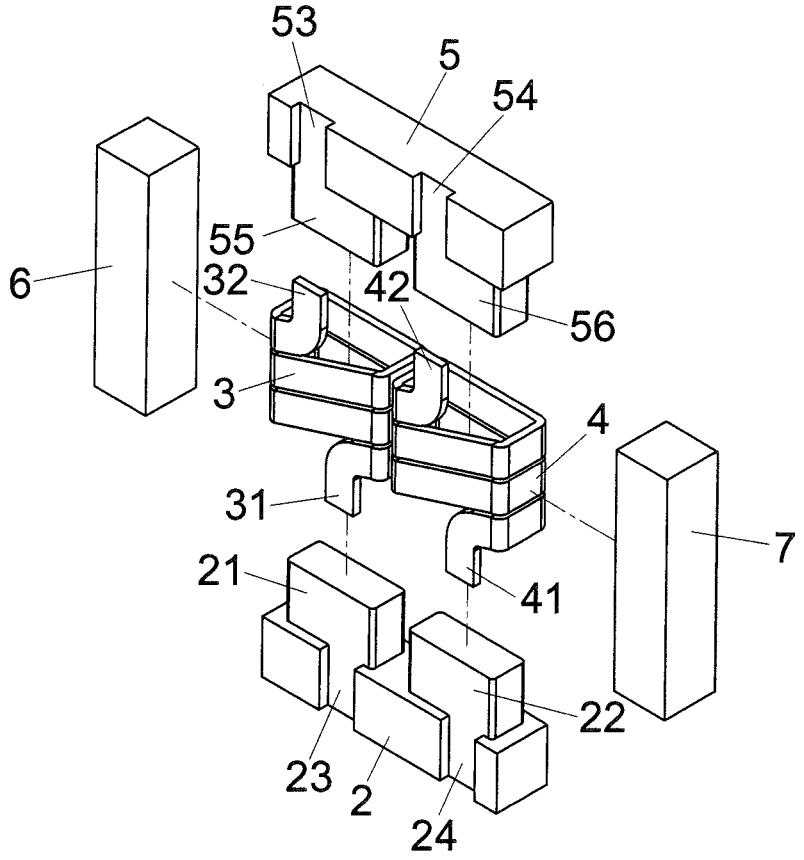
FIG. 2 is a perspective breakdown diagram showing a large-current inductor according to a first embodiment of the present invention.
Figure 3:
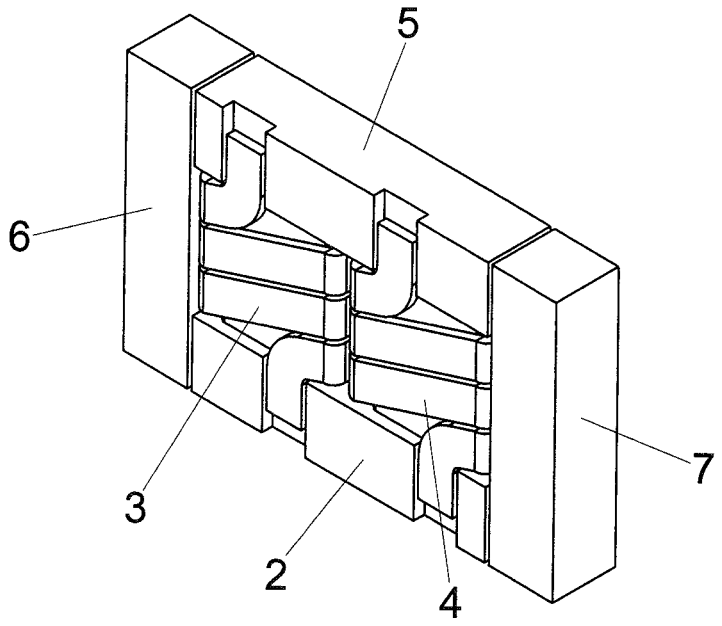
FIG. 3 is a perspective diagram showing the large-current inductor of FIG. 2 after assembly.

As shown in FIGS. 2 and 3, a large-current inductor according to a first embodiment of the present invention includes a first core member 2, a first coil member 3, a second coil member 4, a second core member 5, a third core member 6, and a fourth core member 7.

The first core member 2 has a first winding piece 21 and a second winding piece 22, both extended in parallel from a top side, and a first indentation 23 and a second indentation 24 both arranged in parallel on a front side, of the first core member 2. The first coil member 3 has a first portion wound around the first winding piece 21, and has a first end section 31 embedded into the first indentation 23. The second coil member 4 has a first portion wound around the second winding piece 22, and has a first end second 41 embedded into the second indentation 24.

The second core member 5 has a third winding piece 55 and a fourth winding piece 56, both extended in parallel from a bottom side, and a third indentation 53 and a fourth indentation 54 both arranged in parallel on a front side, of the second core member 5. The first coil member 3 has a separate second portion wound around the third winding piece 55, and has a second end section 32 embedded into the third indentation 53. The second coil member 4 has a second portion wound around the fourth winding piece 56, and has a second end second 41 embedded into the fourth indentation 54. The third core member 6 is attached and joined, for example by adhesive, to first lateral sides of the first and second core members 2 and 5. The fourth core member 7 is attached and joined to second lateral sides, opposite to the first lateral sides, of the first and second core members 2 and 5.

In the present embodiment, the configuration of the third and fourth core members 6 and 7 increases the length of the magnetic coupling path, thereby enhancing the efficiency of energy storage by the mutual inductance. In addition, leakage inductance to limit large current flow is also respectively produced between the third and first core members 6 and 1, and between the fourth and second core members 7 and 5.

Figure 4:
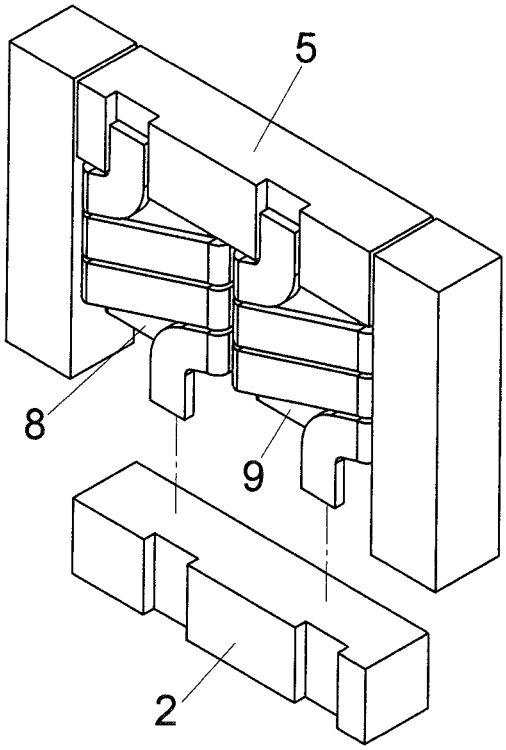
FIG. 4 is a perspective diagram showing a large-current inductor according to a second embodiment of the present invention.

In a second embodiment as shown in FIG. 4, the first and third winding pieces 21 and 55 of the previous embodiment are replaced by an integral fifth winding piece 8 which is directly extended from the second core member 5. Similarly, the second and fourth winding pieces 22 and 56 of the previous embodiment are replaced by an integral sixth winding piece 9 which is directly extended from the second core member 5. The first core member 2 is detachably joined to the first and sixth winding pieces 8 and 9. The present second embodiment may achieve the same effect and function as the previous first embodiment.

Figure 5:
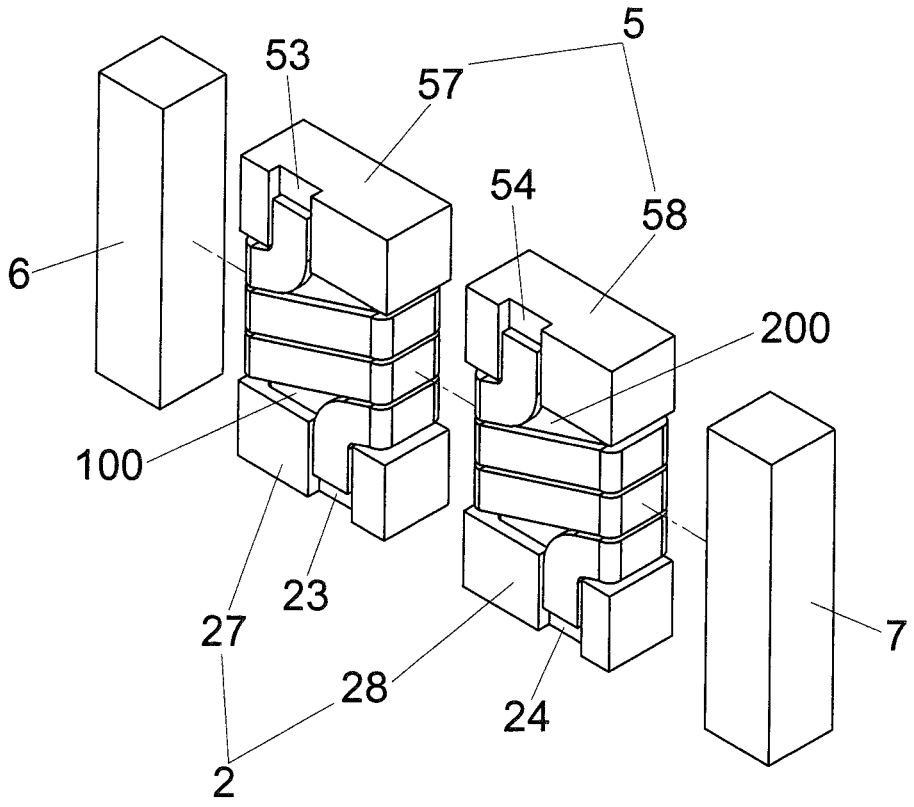
FIG. 5 is a perspective breakdown diagram showing a large-current inductor according to a third embodiment of the present invention.

In a third embodiment shown in FIG. 5, the first core member 2 of the previous embodiments is separated into a first core block 27 and a second core block 28, where the first and second indentations 23 and 24 are respectively provided. Similarly, the second core member 5 of the previous embodiments is separated into a third core block 57 and a fourth core block 58, where the third and fourth indentations 53 and 54 are respectively provided. The first and third winding pieces 21 and 55 of the first embodiment are replaced by an integral seventh winding piece 100, and the second and fourth winding pieces 22 and 56 of the first embodiment are replaced by an integral eighth winding piece 200. The first core member 2 is detachably joined to the first and sixth winding pieces 8 and 9. The present second embodiment may achieve the same effect and function as the previous first embodiment. The seventh winding piece 100, the first core block 27, and the third core block 57 may be integrally formed together. The eight winding piece 200, the second core block 28, and the fourth core block 58 may be integrally formed together. The present third embodiment may achieve the same effect and function as the previous embodiments.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A large-current inductor, comprising:

a first core member having a first winding piece, a second winding piece, a first indentation, and a second indentation, where the first and second winding pieces are extended in parallel from a top side, and the first and second indentations are provided in parallel on a front side, of the first core member;

a first coil member having a first portion wound around the first winding piece, and a first end section embedded into the first indentation;

a second coil member having a first portion wound around the second winding piece, and a first end second embedded into the second indentation;

a second core member having a third winding piece, a fourth winding piece, a third indentation, and a fourth indentation, where the third and fourth winding pieces are extended in parallel from a bottom side, and the third and fourth indentations are provided in parallel on a front side, of the second core member, the first coil member has a separate second portion wound around the third winding piece, and a second end section embedded into the third indentation, the second coil member has a second portion wound around the fourth winding piece, and a second end second embedded into the fourth indentation;

a third core member attached and joined to first lateral sides of the first and second core members; and a fourth core member attached and joined to second lateral sides, opposite to the first lateral sides, of the first and second core members.

2. The large-current inductor according to claim 1, wherein the first and third winding are integrated into a fifth winding piece which is extended from the second core member; the second and fourth winding pieces are integrated into a sixth winding piece which is extended from the second core member; and the first core member is detachably joined to the first and sixth winding pieces.

3. The large-current inductor according to claim 1, wherein the first core member comprises a first core block and a second core block; the first and second indentations are respectively provided on the first and second core blocks; the second core member comprises a third core block and a fourth core block; the third and fourth indentations are respectively provided on the third and fourth core blocks; the first and third winding pieces are integrated into a seventh winding piece; the second and fourth winding pieces are integrated into an eighth winding piece; the seventh winding piece, the first core block, and the third core block are integrally formed together; and the eight winding piece, the second core block, and the fourth core block are integrally formed together.

* * * * *